US009287638B2

(12) United States Patent
Germani

(10) Patent No.: US 9,287,638 B2
(45) Date of Patent: Mar. 15, 2016

(54) MULTIPOLE ELECTRICAL CONNECTOR WITH SPRING CONTACTS

(71) Applicant: INDUSTRIA LOMBARDA MATERIALE ELETTRICO—I.L.M.E. S.P.A., Milan (IT)

(72) Inventor: Emilio Germani, Legnano (IT)

(73) Assignee: INDUSTRIA LOMBARDA MATERIALE ELETTRICO—I.L.M.E. S.P.A., Milan (IT)

( * ) Notice: Subject to any disclaimer, the term of this patent is extended or adjusted under 35 U.S.C. 154(b) by 37 days.

(21) Appl. No.: 14/077,717

(22) Filed: Nov. 12, 2013

(65) Prior Publication Data

US 2014/0141657 A1 May 22, 2014

(30) Foreign Application Priority Data

Nov. 20, 2012 (IT) ..... MI2012A1974

(51) Int. Cl.
*H01R 9/24* (2006.01)
*H01R 4/48* (2006.01)

(52) U.S. Cl.
CPC ..... *H01R 4/48* (2013.01); *H01R 4/4836* (2013.01); *H01R 4/4845* (2013.01); *H01R 9/24* (2013.01)

(58) Field of Classification Search
CPC ..... H01R 9/24
USPC ..... 439/709
See application file for complete search history.

(56) References Cited

U.S. PATENT DOCUMENTS

| | | | | |
|---|---|---|---|---|
| 6,280,233 | B1 | 8/2001 | Beege et al. | |
| 7,438,587 | B2 | 10/2008 | Germani | |
| 2002/0155760 | A1* | 10/2002 | Brand | H01R 4/4827 439/683 |
| 2007/0207662 | A1* | 9/2007 | Germani | H01R 4/4845 439/436 |
| 2011/0207361 | A1 | 8/2011 | Heckert et al. | |

FOREIGN PATENT DOCUMENTS

| | | | |
|---|---|---|---|
| CN | 101051711 | A | 10/2007 |
| DE | 299 15 512 | U1 | 2/2001 |
| DE | 201 06 710 | U1 | 9/2001 |
| DE | 102007009082 | A1 | 9/2007 |
| DE | 20 2008 014 469 | U1 | 4/2010 |
| EP | 1 309 036 | A1 | 5/2003 |

OTHER PUBLICATIONS

European Search Report mailed Jun. 18, 2013; IO 35933 IT MI20121974.

* cited by examiner

*Primary Examiner* — Abdullah Riyami
*Assistant Examiner* — Justin Kratt
(74) *Attorney, Agent, or Firm* — Ladas & Parry LLP

(57) ABSTRACT

An improved multipolar electrical connector with spring contacts suitable for making electrical wiring for civil and/or industrial purposes, comprising a connector body inside which are arranged the spring contacts for the locking of conductors inserted in receptacles formed in said connector body, the spring contacts which lock/unlock the conductors by means of actuator pins sliding with respect to additional receptacles, the connector comprising also means for a rapid and easy access of a probe of a testing device to allow electrical measurements with the conductors blocked by the actuator pins.

8 Claims, 4 Drawing Sheets

MULTIPOLE ELECTRICAL CONNECTOR WITH SPRING CONTACTS

Figure 1:
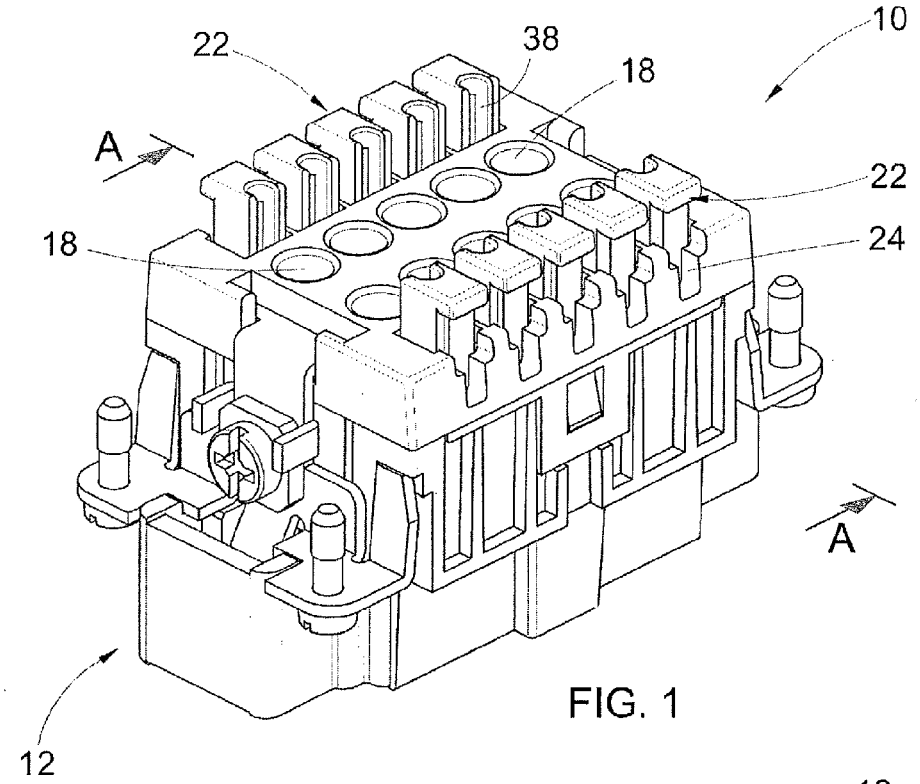

The present invention relates to an improved multipolar electrical connector with spring contacts.

More particularly, the present invention relates to an improved multipolar electrical connector suitable for making electrical wiring for civil and/or industrial purposes.

As it is known, electrical connectors are electromechanical devices that connect and separate both electrically and mechanically two or more elements of a circuit without interfering with other elements of the same circuit.

Electrical connectors act as a "bridge" between individual parts of electronic instruments or of electrical installations, facilitating their assembly and their maintenance, inspection and/or repair; moreover, they allow to rationalize the electrical wiring in view of a containing its dimensions and improving its configuration.

Typically, the electrical connectors are of the screw-type, in which the opening and closing of the terminals for the connection of the conductors during the wiring is made by acting, by means of a screwdriver or an equivalent tool, on a screw which forces the terminal and, consequently, locks the conductor in its housing seat.

However, these types of connectors have some drawbacks related to the fact that the conductor may escape from its seat due to an improper tightening or due to a loosening of the screw; also, the same connectors, due to the presence itself of the tightening screws, do not render wiring operations quick and easy.

To solve these drawbacks spring-type multipole electrical connectors have been developed, in which each conductor is clamped to the connector by means of a spring contact; in these types of connectors, the opening and/or closing of the clamps for the clamping of the conductors is made by means of a tool (e.g.: a screwdriver) which acts by pressure on a spring of the terminal accessing it through a suitable opening provided in a position adjacent to the seat of insertion of the conductor.

However, even this solution idea, although improved with respect to that of the screw-type connector, has some severe drawbacks related to the fact that it requires a certain experience and/or training of the operator in order to prevent any accidental damage to the spring terminal which may compromise the good quality of the electrical connection; the cited drawbacks may occur, for example, due the use of an inadequate tool or due to an incorrect mode of execution of the clamps' opening/closing operations.

According to further embodiments, described e.g. in DE 10 2007 009 082 C5 (also published as U.S. Pat. No. 7,438,587 B2 or CN 101 051 711 B) the multipole electrical connectors are equipped with spring clamp contacts, equipped, for each terminal, of an actuator pin adapted to provide the closure and the possible reopening of the terminal; these actuator pins allow the operation of the spring clamp and, therefore, the closure of the conductor to the contact, without the need to use tools and making, therefore, the wiring quick, easy as well as economical and independent of the skill of the operator.

However, this solution, while solving some of the problems of the solutions outlined above, presents some major drawbacks related to the fact that the actuator pins, generally of prismatic shape, are going to occlude the access to the conductive parts of the spring clamp terminals and, consequently, do not offer contact points to the connector terminals, preventing measures of electrical continuity, impedance or the like; these measurements are possible only with the disassembling of the connector. The main task of the present invention is, therefore, to obviate the above drawbacks. More particularly, the purpose of the present invention is to provide an improved multipolar electrical connector with spring contacts that associate with the convenience of using a spring-type multipolar electrical connector provided with actuator pins for the closure of the terminals, the possibility to make measurements of electrical continuity, impedance or the like, quickly, easily and without the need to disassemble the electrical connector or to open the terminals.

A further object of the present invention is to provide a multipolar electrical connector able to allow quick and easy electrical measurements by means which do not alter the characteristics of robustness and effectiveness of the connector itself.

A further object of the present invention is to provide an improved electrical connector provided with means to allow the electrical tests in compliance with the industry standards in regard to the coordination of electrical insulation for the rated voltage value assigned to the connector.

A further object of the present invention is to put at the disposal of users an improved multipolar electrical connector with spring contacts able to ensure a high level of durability and reliability in time and, additionally, that it may be easily and economically realized.

These and other objects, which will appear more clear hereinafter, are achieved in accordance with the characteristics listed in the enclosed independent claim 1.

According to the invention an improved multipolar electrical connector with spring contacts is provided, comprising a connector body inside which the spring contacts for the clamping of wires are arranged, inserted in receptacles formed in said connector body, said spring contacts which lock/unlock the conductors by means of actuator pins sliding with respect to further receptacles of the connector body, the connector comprising also means for a quick and easy access of a probe of a testing device to allow electrical measurements with the conductors blocked by the actuator pins.

Figure 2:
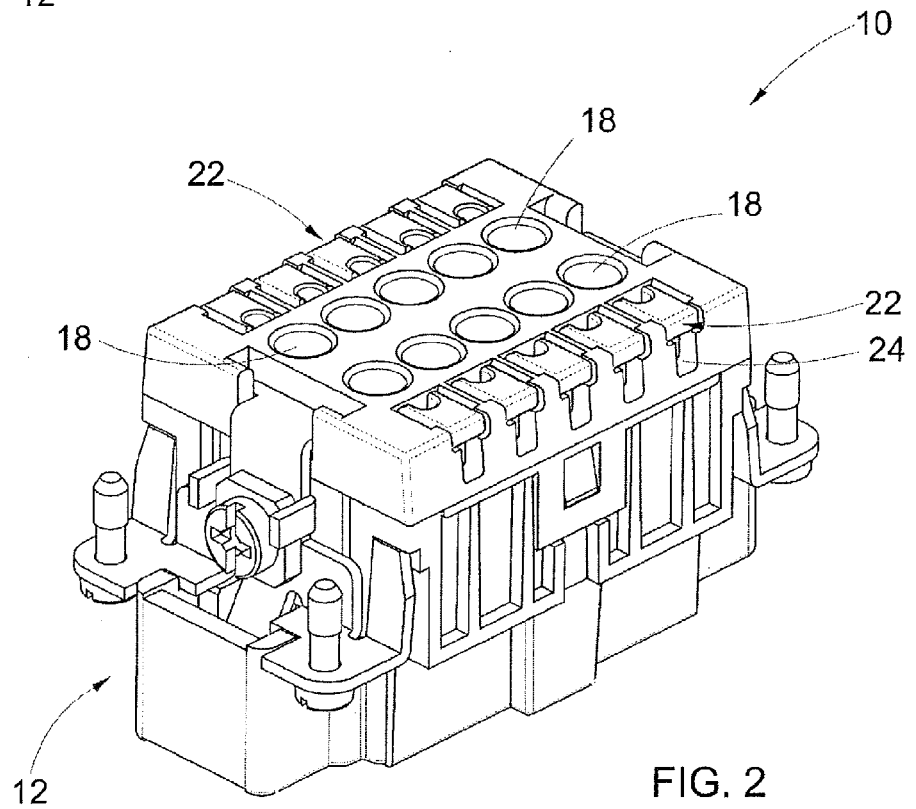
Figure 3:
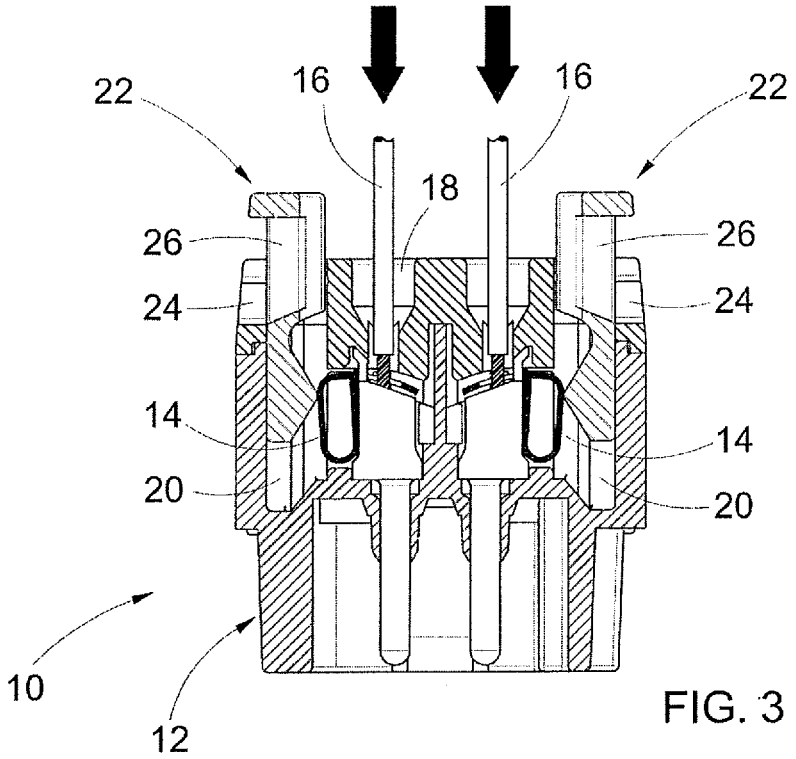
Figure 4:
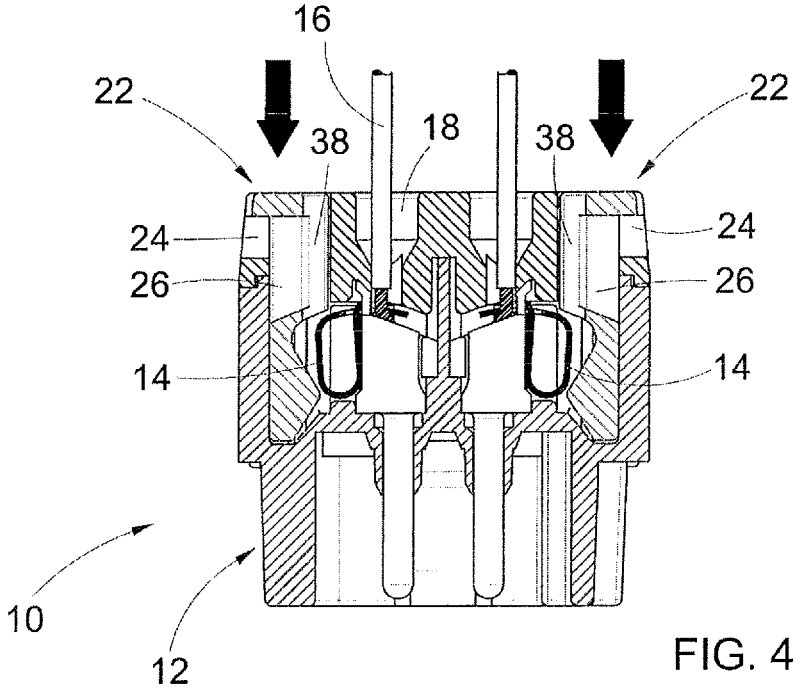
Figure 5:
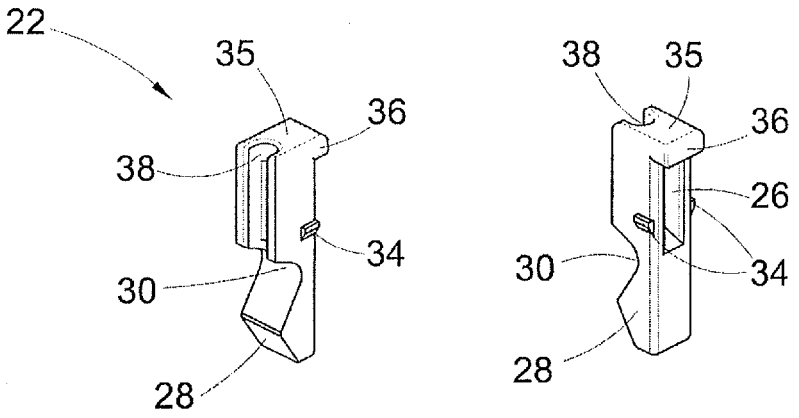
Figure 6:
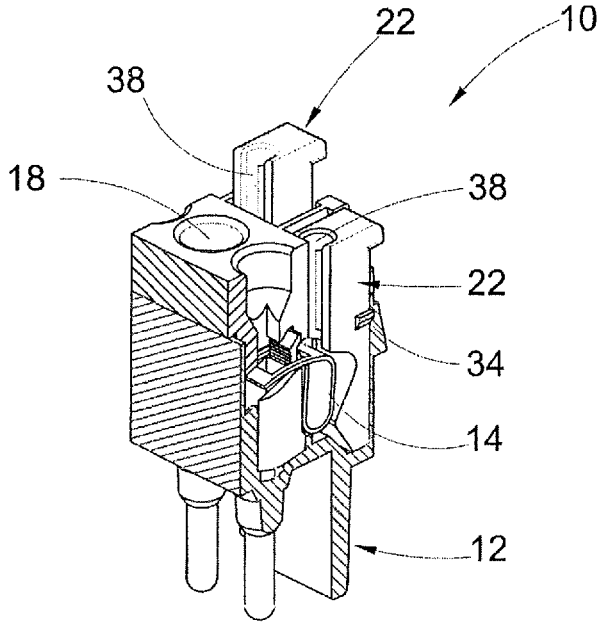
Figure 7:
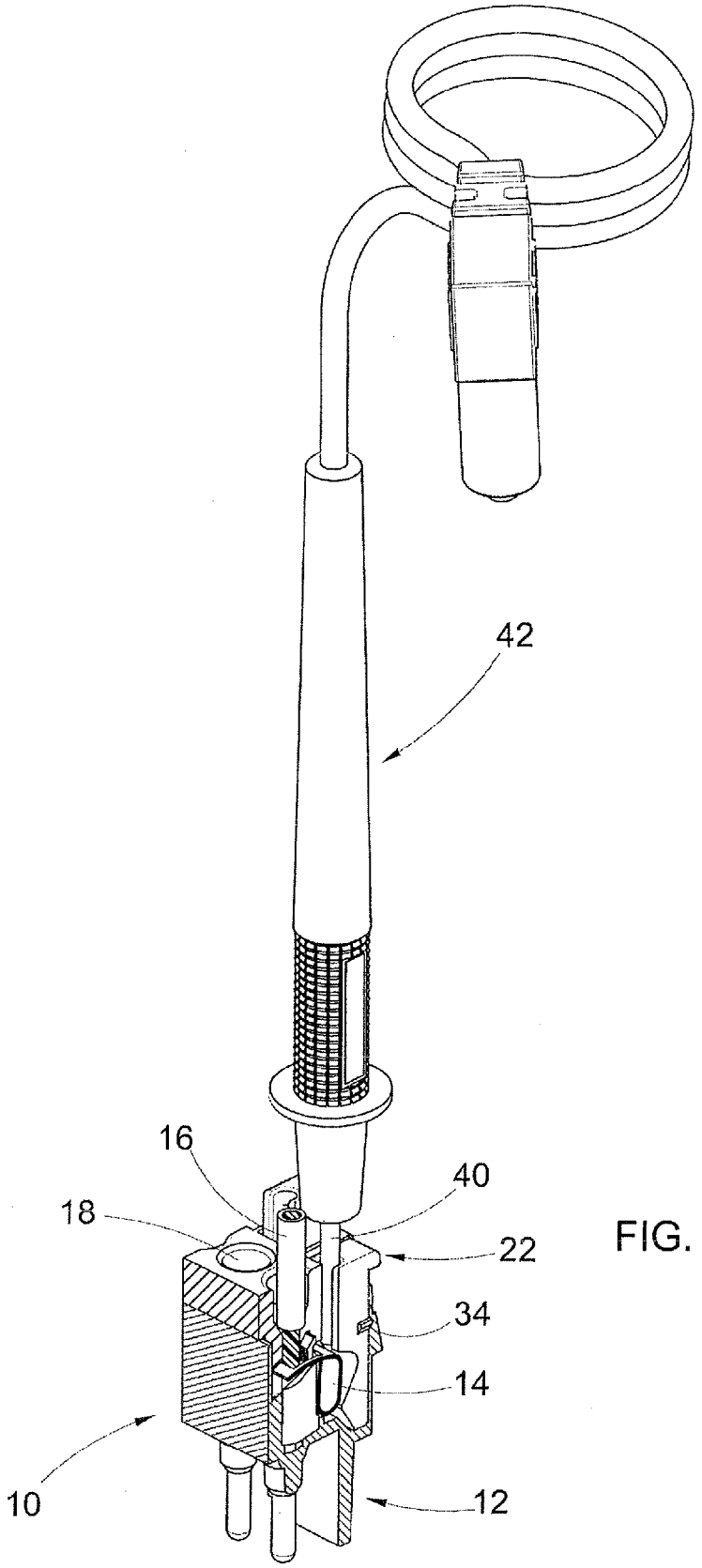

The constructional and functional characteristics of the improved multipolar electrical connector with spring contacts of the present invention will be better understood from the following detailed description, in which reference is made to the enclosed drawing tables which illustrate a preferred and not limiting embodiment, in which:

FIG. 1 schematically represents an isometric view of the improved multipolar electrical connector with spring contacts of the present invention prepared for the wiring of a plurality of conductors;

FIG. 2 schematically represents the multipolar electrical connector of FIG. 1 in the configuration suitable for the clamping of the conductors;

FIG. 3 represents at schematic level a sectional view according to a plane A-A of the connector of FIG. 1 with a pair of conductors inserted into the connector itself;

FIG. 4 schematically shows the sectional view of FIG. 3 with the pair of conductors clamped in the connector;

FIG. 5 schematically shows two isometric views of an actuator pin of the electrical connector of the invention;

FIG. 6 schematically represents an isometric view of a portion of the connector of the invention sectioned according to two orthogonal planes;

FIG. 7 schematically represents the portion of the electrical connector according to FIG. 6 when carrying out an electrical measurement/verification by means of a tester.

With reference to the above figures, the improved multipolar electrical connector with spring contacts of the present invention, indicated as a whole by 10 into the figures, comprises a connector body 12 inside which spring contacts 14 are arranged (the characteristics of which are not described in detail as already known) for the clamping of conductors 16 inserted in receptacles 18 formed in the same connector body 12, with said connector body provided with further receptacles 20, corresponding in number to that of the receptacles 18, arranged parallel and externally to said receptacles 18 and suitable to accommodate an actuator pin 22 which, sliding inside said further receptacle 20, allows to lock and unlock the conductor 16 as shown schematically in FIGS. 3 and 4.

The connector body 12 has, moreover, windows 24 formed in the upper side wall of the connector body adjacent to the further receptacles 20 and to seats 26 present in the upper part of each actuator pin 22.

The individual actuator pin 22, shown schematically in detail in FIG. 5, presents an essentially prismatic shape with a lower portion 28 shaped tendentially as a wedge to engage with the individual spring contact 14 deforming it so as to determine its opening (FIG. 3—actuator pin partially extracted from the further receptacle 20) and with a possible recess 30 arranged above the lower portion 28 and adapted to allow spring contacts to move back in undeformed rest position (FIG. 4—actuator pin fully inserted and not protruding from the further receptacle 20).

The upper part of the actuator pin, from the opposite side with respect to the lower portion 28, presents the seat 26 which faces with the corresponding window 24 of the connector body and is adapted to receive a tool or tool (e.g.: a screwdriver or an awl) to force the partial withdrawal of the actuator pin from to the further receptacle 20 allowing to unlock the conductor 16 for the extraction of the same.

On the vertical side surface of the individual actuator pin 22 a pair of opposed tabs 34 is disposed in correspondence of the lower half of the same, adapted to prevent the removal of the aforementioned pin with respect to its housing/sliding receptacle.

The base or top face 35 of the actuator pin 22 shows an expansion 36 developed according to a horizontal plane directed away from the recess 30 and adapted to make contact with the upper surface of the window 24 defining, in this way, a limit (end stroke) element for the sliding of the pin inside the further actuator receptacle 20.

Upon the making of the electrical wiring, the operator inserts the conductors 16 in dedicated receptacles 18 and in the spring contacts 14 of the connector body 12 that, in this initial configuration, shows the actuator pins partially withdrawn from the additional receptacles 20 and, subsequently, by exerting pressure on said actuator pins determines the descent by sliding in the respective receptacles realizing the locking of the conductors, as shown schematically in FIGS. 3 and 4.

For the release of the conductors 16 it is necessary to withdraw the actuator pins 22 from the additional receptacles 20 so that the lower portions 28 of the actuator pins, acting on the spring contacts 14 determine their deformation and the consequent disengagement of the conductors with respect to the contacts; the lifting of the actuator pins 22 is realized by acting with a tool whose tip is introduced in the seat 26 of each pin through the window 24.

Moreover, the actuator pin 22, starting from said base or top face 35, on the side opposite to that of development of the expansion 36, has an opening 38 facing longitudinally extended in the direction of the spring contact, defined by a groove with profile in cross section, preferably but not exclusively, semi-circular and adapted to put the individual spring contact 14 in communication with the exterior.

Such a longitudinally extended opening 38, as schematically well shown in FIG. 7, allows the introduction of a probe 40 of a testing device 42 defined, for example, by a tester for checking the presence of electrical contact, of voltage, impedance, etc. when the conductor 16 is inserted in the receptacle 18 and locked by the actuator pin 22.

In an alternative embodiment configuration the opening is defined by a longitudinally extended groove with cross section profile of type mixtilinear or semi-square or semi-rectangular.

In a further alternative embodiment, the groove 38 is defined by a through hole with circular or square cross section, extended in the longitudinal direction inside the actuator pin so as to connect the spring contact with the outside.

As can be seen from the foregoing, the advantages that the improved multipolar electrical connector with spring contacts of the present invention achieves are obvious. The improved multipolar electrical connector with spring contacts of the present invention advantageously allows to associate to the practicality of use of a spring-type multipolar electrical connector provided with actuator pins for the closure of the terminals, the possibility of making measurements of electrical continuity, impedance or the like quickly, smoothly and without the necessity of having to disassemble the electrical connector or open its terminals to access the contact zone, that would interrupt the electrical continuity and thus the operation of the circuit required to perform tests and measurements on a connector coupled and under voltage.

Additionally advantageous is the fact that this opening or longitudinal groove made directly on each actuator pin allows to preserve the robustness and effectiveness of the actuator while keeping compliance with the standards for the coordination of the electrical insulation for the rated voltage value associated with the connector; the opening, made as detailed above, does not create shortcuts for surface currents creepage and/or does not involve a reduction of the clearance towards parts potentially at opposite polarity.

Additionally advantageous is the fact that the actuator pin provided with longitudinally extended opening or groove is a solution of easy and economic realization with reference to the process of production of the product.

Although the invention has been described above with particular reference to a preferred and not limiting embodiment, several modifications and variations will be apparent to one skilled in the art in light of the above description. The present invention, therefore, intends to embrace all modifications and variations that fall within the scope of the following claims.

The invention claimed is:

1. An improved multipole electrical connector with spring contacts suitable for making electrical wiring for civil and/or industrial purposes, comprising a connector body inside of which are arranged the spring contacts for the locking of conductors inserted in receptacles formed in said connector body, the spring contacts which lock/unlock the conductors by means of actuator pins sliding with respect to additional receptacles, wherein the connector further comprises a means for a quick and easy access of a probe of a testing device to allow electrical measurements with the conductors blocked by the actuator pins, said means being formed on the actuator pins themselves.

2. The multipole electrical connector according to claim 1, wherein said means are defined by a longitudinally extended opening facing in the direction of the spring contact.

3. The multipole electrical connector according to claim 2, wherein said longitudinally extended opening is defined by a groove with curved profile.

4. The multipole electrical connector according to claim 3, wherein the groove has a semicircular profile.

5. The multipole electrical connector according to claim 3, wherein the groove has a mixtilinear profile.

6. The multipole electrical connector according to claim 3, wherein the groove has a semi-squared or semi-rectangular profile.

7. The multipole electrical connector according to claim 2, wherein longitudinally extended opening is defined by a circular cross section through hole.

8. The multipole electrical connector according to claim 2, wherein said longitudinally extended opening is defined by a quadrangular cross section through hole.

* * * * *